US005778599A

United States Patent [19]

Saito

[11] Patent Number: 5,778,599

[45] Date of Patent: Jul. 14, 1998

[54] GLASS HOLDER AND METHOD FOR ATTACHING A WINDOW GLASS USING SUCH A GLASS HOLDER

[75] Inventor: Kazuo Saito, Yokohama, Japan

[73] Assignee: Illinois Tool Works Inc., Glenview, Ill.

[21] Appl. No.: 635,821

[22] Filed: Apr. 22, 1996

[30] Foreign Application Priority Data

Apr. 20, 1995 [JP] Japan ..... 7-119306

[51] Int. Cl.[6] ..... E05F 11/38

[52] U.S. Cl. ..... 49/375

[58] Field of Search ..... 49/374, 375, 348, 49/349, 350, 351

[56] References Cited

U.S. PATENT DOCUMENTS

| | | | |
|---|---|---|---|
| 5,363,595 | 11/1994 | Wirsing | 49/375 |
| 5,502,926 | 4/1996 | Grace et al. | 49/375 |
| 5,515,651 | 5/1996 | Hofmann et al. | 49/375 |
| 5,537,783 | 7/1996 | Kazino et al. | 49/375 |
| 5,546,704 | 8/1996 | Maruoka | 49/375 |
| 5,622,005 | 4/1997 | Ochenski et al. | 49/375 |

*Primary Examiner*—Jerry Redman

*Attorney, Agent, or Firm*—Schwartz & Weinrieb

[57] ABSTRACT

A window glass holder comprises a pair of axially spaced plate members having coaxial through-bores defined therein. A first one of the plate members has a protrusion which comprises a shoulder portion and an inclined ramp portion. The second one of the plate members has a metal nut member embedded therein. When a window glass is to be inserted into the window glass holder, the bottom edge portion of the window glass is inserted into the space defined between the pair of plate members such that the bottom edge portion of the window glass encounters the inclined ramp portion of the first plate member causing the first plate member to move away from the second plate member. When a through-bore defined within the window glass is coaxial with the through-bore and protrusion of the first plate member, the protrusion will be snap-fittingly engaged within the through-bore of the window glass whereby the window glass will be fixedly retained within the window glass holder. A threaded bolt fastener can be inserted through through-bores of the rail member, the plate members of the window glass holder, and the window glass so as to threadedly engage the nut member of the second plate member whereby the window glass holder and the window glass are fixedly secured to the rail member.

20 Claims, 8 Drawing Sheets

GLASS HOLDER AND METHOD FOR ATTACHING A WINDOW GLASS USING SUCH A GLASS HOLDER

FIELD OF THE INVENTION

The present invention relates generally to window glass holders, and more particularly to a window glass holder which is particularly useful in connection with a rail member of a window elevating-and-lowering assembly used within window systems housed within automobile doors, and a method of mounting the window glass within the window glass holder and upon the rail member of the window elevating-and-lowering assembly.

BACKGROUND OF THE INVENTION

With reference being made initially to FIG. 13, a conventional elevating-and-lowering assembly mounted within an automotive vehicle door and provided for raising and lowering a vehicle window is seen to comprise a pair of arms a and b which are pivotably connected to each other at substantially central portions thereof such that the arm assembly has a substantially X-shaped configuration. One end of each one of the arms a and b is pivotably and slidably connected to a vertically movable rail member c of the window elevating-and-lowering assembly, while the other end of the arm b is pivotably and slidably connected to a fixed rail d. A regulator f is provided with a pinion gear g with which a rack gear e is engaged, and the other end of the arm a is fixed to the rack gear e. As the pinion gear g of regulator f drives rack gear e, the latter causes pivotable movement of the arm a which, in turn and through means of cooperation with arm b, causes vertically movable rail member c, and vehicle glass window h which is supportably mounted thereon, to be moved vertically upwardly or downwardly.

It has also been a long-standing practice, in connection with the mounting of the glass window h upon the vertically movable rail member c, to attach the glass window h to a window glass holder, and to, in turn, mount or attach the window glass holder to the vertically movable rail member c. A conventional window glass holder i is illustrated within FIGS. 10–12, and the same in more particularly disclosed within Japanese Utility Model HEI 7-6006. The window glass holder i is fabricated from a suitable synthetic resin material and it has a substantially U-shaped cross-sectional configuration. More particularly, the holder i includes a main body portion or unit 1 which comprises a pair of engagement members or plates j and k wherein the members or plates j and k are spaced apart from each other so as to permit the vehicle glass window h to be inserted therebetween. A cylindrical protrusion m is integrally formed with plate j so as to project toward plate k, and an aperture n is provided within plate k so as to accommodate cylindrical protrusion m therewithin. The inner periphery of the bore defined within the cylindrical protrusion m is internally threaded for a purpose which will become apparent shortly.

In order to mount the vehicle glass window h upon the vertically movable rail member c so that the vehicle glass window h can be raised and lowered as desired, the vehicle glass window h must first be mounted within the window glass holder i. Referring then to FIG. 10, and more particularly to FIG. 10(A) thereof, it is seen that the vehicle glass window h is provided with a through-aperture o. When the vehicle glass window h is to be mounted within the window glass holder i, the plate members j and k are initially moved apart from each other so as to disengage or remove the cylindrical protrusion m of plate member j from the aperture n of plate member k whereby the vehicle glass window h is able to be inserted therebetween. When the vehicle glass window h has been inserted into the window glass holder i such that the aperture o of the vehicle glass window h is aligned with the protrusion m of plate member j and the aperture n of the plate member k, the protrusion m of plate member j is able to extend through aperture o of the glass window h and into the aperture n of the plate member k whereby the vehicle glass window h is fixedly secured within the window glass holder i as seen in FIG. 10(B). The rail member c is provided with a window glass holding piece p which has a substantially U-shaped configuration so as to support the vehicle glass window h-window glass holder i subassembly therein. As shown in FIG. 11, a threaded bolt fastener r is inserted through an aperture q provided within the subassembly comprising vertically movable rail member c and window glass holding piece p so as to be threadedly mated with the internally threaded bore of protrusion m of the plate member j.

While the conventional window glass holder i can adequately support the vehicle glass window h and has enabled the glass window h to be mounted upon the vertically movable rail member c so as to be vertically movable therewith when the vehicle window h is desired to be raised or lowered, the mounting of the glass window h within the window glass holder i is sometimes difficult in view of the fact that the window h must be inserted between the plate members j and k of the window glass holder i when the plate members j and k are held spaced apart from each other in the relatively opened position illustrated in FIG. 10(A). In addition, while the fixation of the glass window h-window glass holder i subassembly upon the vertically movable rail member c by means of the threaded bolt fastener r is facilitated and rendered quite easy when the rail member c is provided with the window glass holding piece p, such fixation or mounting of the glass window h-window glass holder i subassembly upon the rail member c is rendered quite difficult if the rail member c is not provided with a window glass holding piece p because the glass window h-window glass holder i subassembly must be held and supported such that the threaded bore of the protrusion m of plate member j of the window glass holder i must be maintained aligned with the aperture q of the rail member c while the threaded bolt fastener r is threadedly engaged within the threaded bore of protrusion m of plate member j of the window glass holder i.

OBJECTS OF THE INVENTION

Accordingly, it is an object of the present invention to provide a new and improved window glass holder which facilitates and simplifies the mounting of the vehicle glass window within the window glass holder.

Another object of the present invention is to provide a new and improved window glass holder which permits the window glass holder, and the vehicle glass window mounted therein, to be easily and readily mounted upon the vertically movable rail member even when the vertically movable rail member does not have a glass window holding piece operatively connected thereto.

A further object of the present invention is to provide a new and improved method of attaching or mounting a vehicle glass window within the new and improved window glass holder of the present invention, and to additionally mount and secure the vehicle window glass-window glass holder subassembly onto or upon the vertically movable rail member in a relatively simple and easy manner.

SUMMARY OF THE INVENTION

The foregoing and other objects are achieved in accordance with the present invention through the provision of a vehicle window glass holder which has a substantially U-shaped cross-sectional configuration as defined by a pair of plate members which face each other in a spaced-apart relationship. A bolt insertion hole or through-aperture is defined within each one of the plate members. The vehicle window glass holder is molded from a suitable synthetic resin material, and in accordance with a first embodiment of the invention, a metal nut member is embedded within one of the plate members by insert molding techniques. Alternatively, a nut housing, open substantially along one side thereof, may be molded upon an external surface of one of the plate members so as to permit a hexagonally shaped metal nut member to be removably inserted therein for threaded engagement with a threaded retention bolt fastener.

The plate member, disposed opposite the plate member within which the metal nut member is disposed, is provided with a cylindrical protrusion which defines therein one of the bolt insertion holes or through-apertures, but unlike the conventional vehicle window glass holder, this cylindrical protrusion does not extend into the coaxially aligned bolt insertion hole or through-aperture defined within the other plate member and within which the metal nut member is disposed. To the contrary, this cylindrical protrusion is axially spaced from the other bolt insertion hole or through-aperture and is also provided with an externally tapered or inclined ramp portion. In this manner, when the vehicle glass window is inserted between the oppositely disposed plate members of the window glass holder, the bottom edge portion of the vehicle glass window encounters the tapered or inclined ramp portion of the protrusion thereby forcing that plate member, upon which the cylindrical protrusion is provided, away from the other plate member until the cylindrical protrusion becomes coaxially aligned with the through-bore provided within the vehicle glass window whereby the cylindrical protrusion will, in effect, become snap-fittingly engaged within the through-bore of the vehicle glass window and the plate members will again be disposed in their normal, non-stressed positions with respect to each other. Consequently, the vehicle glass window is able to be easily and readily mounted within the window glass holder by means of a small amount of pushing pressure being exerted upon the vehicle glass window so as to insert the vehicle glass window within the window glass holder by means of the aforenoted snap-fitting engagement defined therebetween. In addition, the need for holding the opposed plate members of the window glass holder apart from each other has been obviated.

A hook-shaped stop member is also integrally formed upon the upper end of the plate member upon which the cylindrical protrusion is formed, and this hook-shaped stop member is adapted to engage the vertically movable rail member in a substantially overlying or encompassing manner. More particularly, when the hook-shaped stop member is seated upon an upper flanged portion of the vertically movable rail member in an overlying mode, or alternatively, when the body portion of the vertically movable rail member is abutted against the plate member upon which the hook-shaped stop member is formed and the upper flanged portion of the vertically movable rail member is abutted against the underlying surface of the overlying hook-shaped stop member, the aperture defined within the body portion of the vertically movable rail member, and through which the threaded bolt fastener is to extend so as to threadedly engage the nut member mounted upon the window glass holder, is automatically coaxially aligned with the bolt insertion holes and the nut member of the plate members of the window glass holder so as to readily permit the insertion of the bolt fastener through the vertically movable rail member and the window glass holder so as to secure the vehicle window glass-window glass holder subassembly upon the vertically movable rail member. Thus, when the threaded bolt fastener is to be inserted through the apertures of the vertically movable rail member, the plate members of the window glass holder, and the vehicle window glass, there is no need to separately hold the window glass holder-vehicle window glass subassembly relative to the vertically movable rail member in order to ensure proper coaxial alignment therebetween, whereby the bolt fastener insertion process is facilitated and rendered easy.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
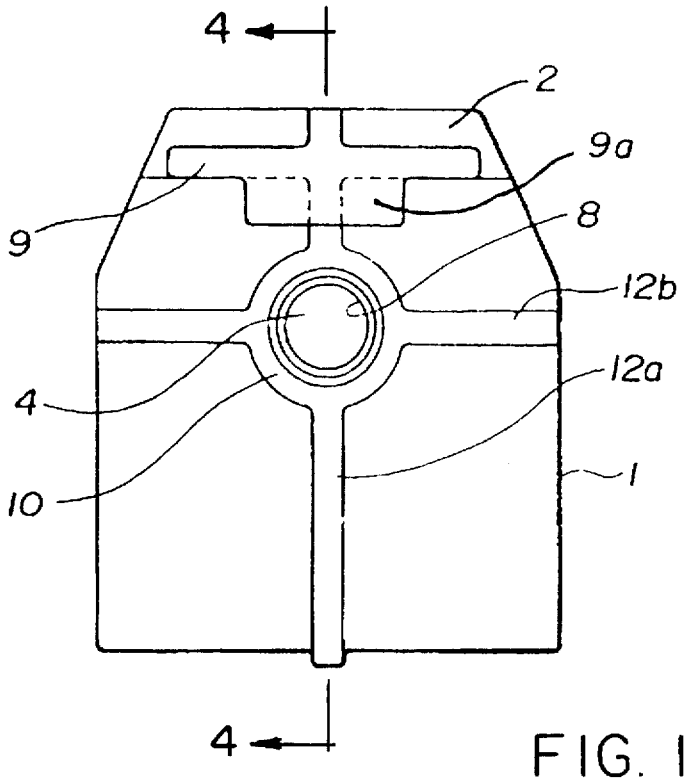
FIG. 1 is a front elevational view of a new and improved window glass holder constructed in accordance with the teachings of the present invention and showing the cooperative parts thereof.
Figure 2:
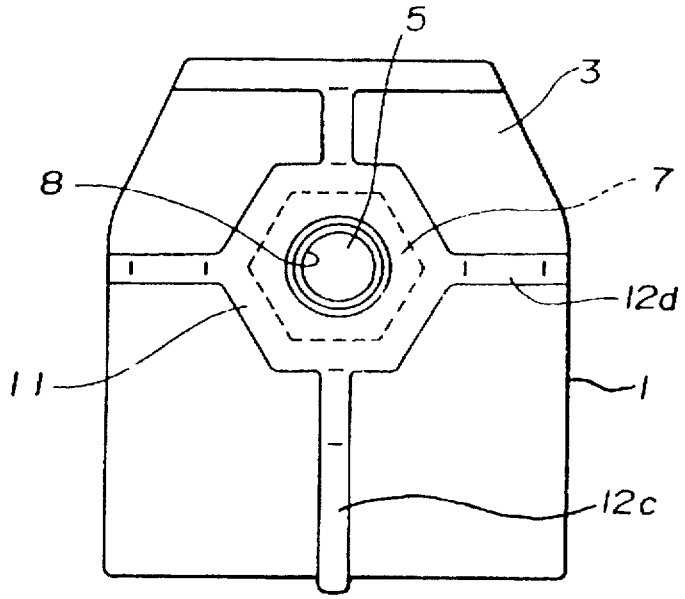
FIG. 2 is a rear elevational view of the new and improved window glass holder shown in FIG. 1.
Figure 3:
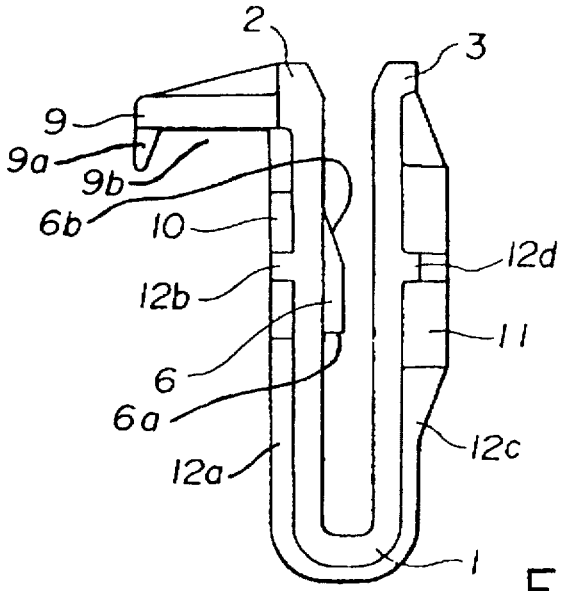
FIG. 3 is a side elevational view of the new and improved window glass holder shown in FIGS. 1 and 2.
Figure 4:
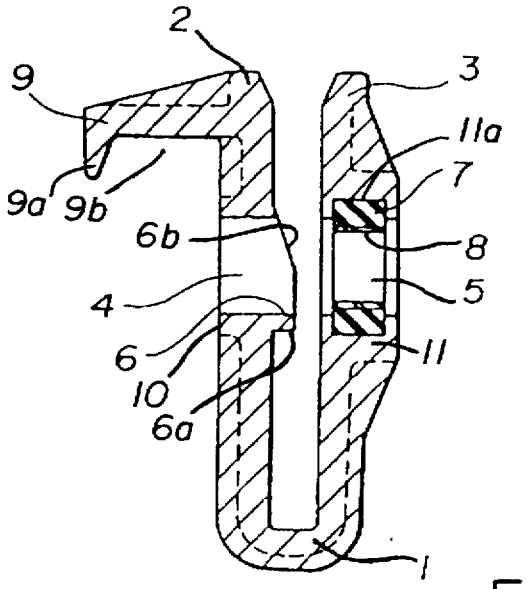
FIG. 4 is a cross-sectional view of the new and improved window glass holder shown in FIG. 1 as taken along the line 4—4 of FIG. 1.

Referring now to the drawings, and more particularly to FIGS. 1–4 thereof, the new and improved window glass holder constructed in accordance with the principles of the present invention is illustrated and denoted by the reference character 1. The window glass holder 1 comprises a molded component which is fabricated from a suitable synthetic resin material, and the holder 1 has a substantially U-shaped cross-sectional configuration as defined by oppositely disposed engagement members or plates 2 and 3. Coaxial through-bores 4 and 5 are respectively provided within the plate members 2 and 3 for permitting a threaded bolt fastener r to pass therethrough, as will be described in more detail hereinafter. More particularly, the through-bore 4 is defined within plate member 2 by means of an annular protrusion 6 which, at its lower end, as best seen for example within FIG. 4, has an axial length which is greater than the axial length or thickness of the plate member 2 such that a shoulder portion 6*a* is accordingly defined for a purpose which will become more apparent hereinafter, while at its upper end, the protrusion 6 has a slanted or inclined ramp surface 6*b* for a purpose which will also become more apparent hereinafter. A metal nut member 7, having an internally threaded portion 8, is embedded within plate member 3 by means of suitable insert molding techniques so as to be coaxial with the through-bore 5 of plate member 3.

The upper end of plate member 2 is integrally provided with a forwardly or outwardly extending stopper or seat member 9 which is further provided with a downwardly extending or dependent hook portion 9*a* such that a downwardly open recessed region 9*b* is defined between hook portion 9*a*, main seat portion or member 9, and the upper end portion of plate member 2. An annular rib portion 10 is provided upon the outer surface of the plate member 2 so as to partially define and strengthen the outer edge portion of the through-bore 4, and additional, mutually orthogonal strengthening rib members 12*a* and 12*b* are also formed upon the outer surface of the plate member 2 so as to be integral with circular rib member 10. In a similar manner, the outer surface of plate member 3 is provided with a thickened reinforcing portion 11 which has a substantially hexagonal configuration. Portion 11 surrounds and defines the through-bore 5, and is provided with an annular recessed portion 11*a* within which the nut member 7 is embedded. Additional mutually orthogonal strengthening rib members 12*c* and 12*d* are also formed upon the outer surface of the plate member 3 so as to be integral with hexagonal portion 11, and as seen from FIGS. 3, 5, and 7, ribs 12*a* and 12*c* are integrally connected to each other at the lower end of the window glass holder 1.

Figure 13:
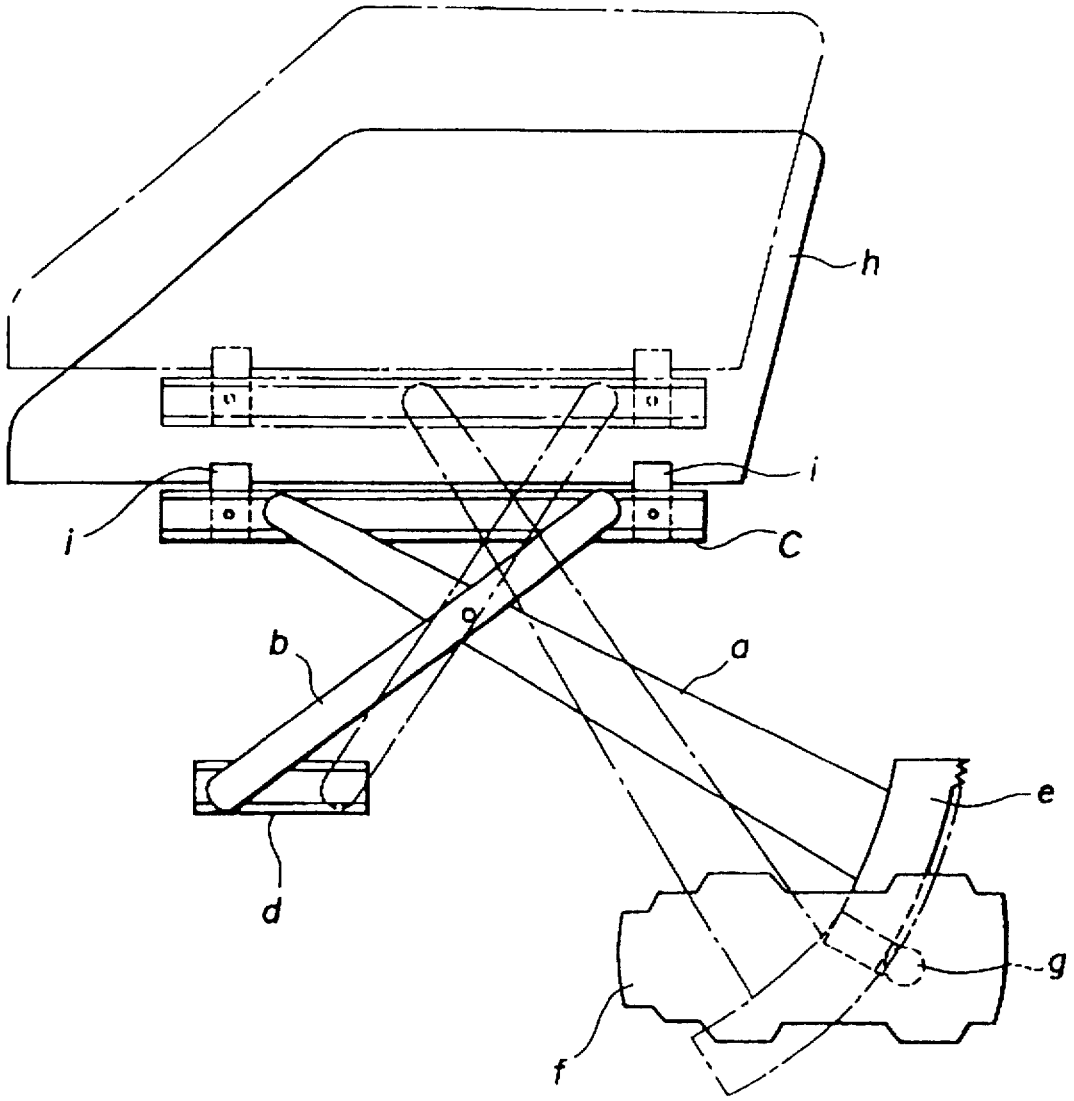
FIG. 13 PRIOR ART
FIG. 13 is a side elevational view of a PRIOR ART automotive door window elevating-and-lowering assembly within which the new and improved window glass holder of the present invention can be used in conjunction with the vertically movable rail member of the automotive door window elevating-and-lowering assembly.

The window glass holder of the present invention is to be used in connection with the holding of a window glass component which is to be mounted within the door panel of an automotive vehicle such that the window glass component can be vertically elevated and lowered between opened and closed positions, and more particularly, the window glass holder of the present invention is to be used in conjunction with the vertically movable rail member c of an elevating-and-lowering assembly such as that shown in FIG. 13. In order to achieve such an assembly with the vertically movable rail member c, the window glass must first be inserted into and retained within the window glass holder 1.

Figure 5:
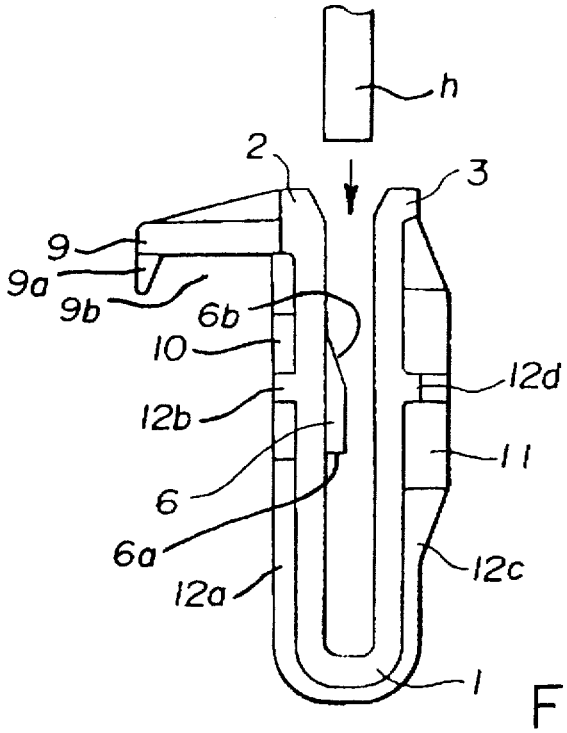
FIG. 5 is a side elevational view, similar to that of FIG. 3, wherein a window glass is illustrated as being inserted into the new and improved window glass holder.
Figure 6:
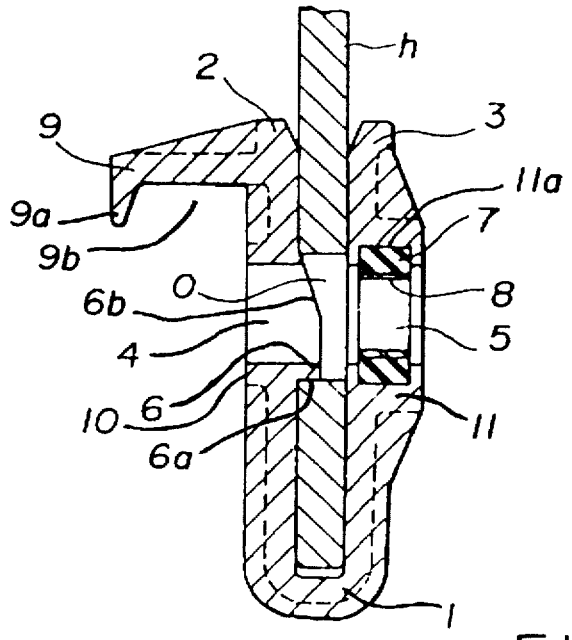
FIG. 6 is a cross-sectional view, similar to that of FIG. 4, illustrating the disposition of the window glass when the same is snap-fittingly engaged within the window glass holder.
Figure 10A:
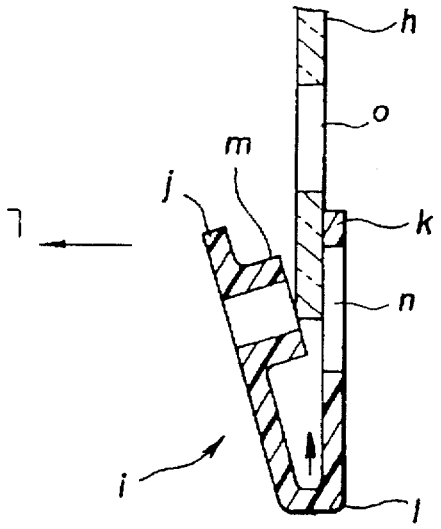
FIG. 10A PRIOR ART
FIG. 10(A) is a cross-sectional view of a PRIOR ART window glass holder as the window glass is being inserted into the PRIOR ART window glass holder.
Figure 10B:
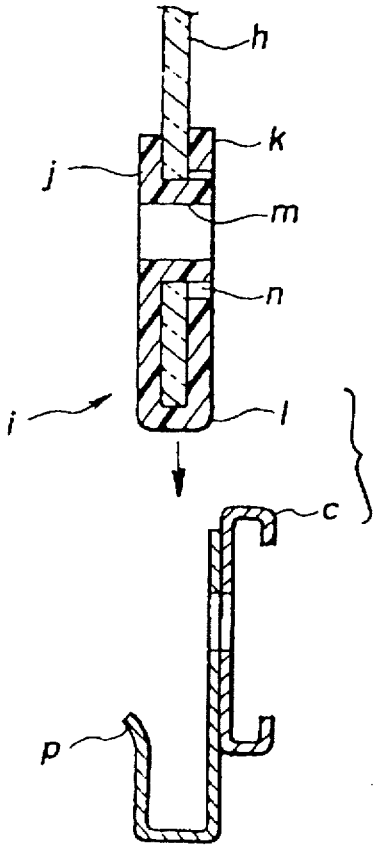
FIG. 10B PRIOR ART
FIG. 10(B) is a cross-sectional view of a PRIOR ART window glass holder, having a window glass fixedly mounted therein, as the PRIOR ART window glass holder, having the window glass fixedly mounted therein, is being mounted within a window glass holding piece operatively connected to a vertically movable rail member.
Figure 11:
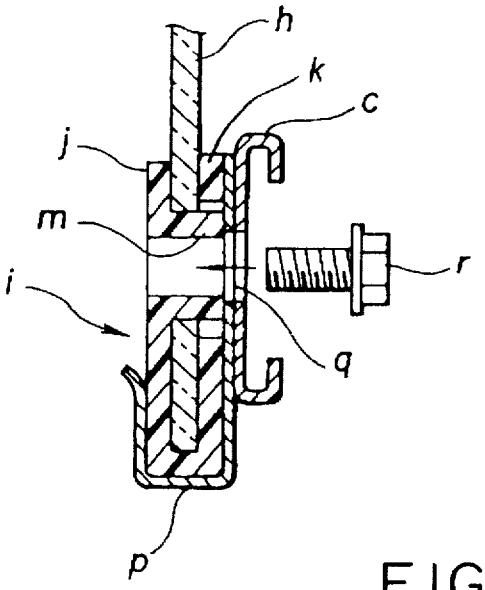
FIG. 11 PRIOR ART
FIG. 11 is a cross-sectional view of the PRIOR ART window glass holder, having the window glass mounted therein, as mounted within the window glass holding piece operatively connected to the vertically movable rail member, and wherein a threaded bolt fastener is being inserted through the rail member, the window glass holding piece, the window glass holder, and the window glass so as to fixedly secure such components together.
Figure 12:
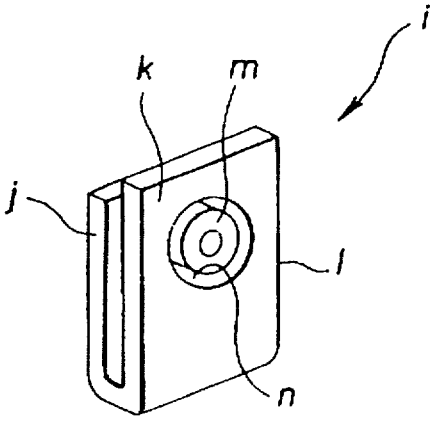
FIG. 12 PRIOR ART
FIG. 12 is a perspective view of the PRIOR ART window glass holder shown in FIG. 10(A)

Referring therefore to FIGS. 5 and 6, the lower edge portion of the window glass h is inserted into the space defined between the plate members 2 and 3 such that the lower edge portion of the window glass h will encounter the upper inclined or ramped surface 6*b* of the protrusion 6 provided upon the plate member 2, and with continued downward pressure or a pushing force exerted upon the window glass h, the plate member 2 will be forced away from plate member 3 until the through-bore or aperture o defined within the window glass h is coaxially aligned with the protrusion 6 of the plate member 2 such that the shoulder portion 6*a* of the protrusion 6 becomes snap-fittingly engaged within the aperture or through-bore o of the window glass h as seen in FIG. 6. At this time, of course, the plate member 2 has returned to its non-stressed or non-expanded normal position with respect to plate member 3 and the window glass h is effectively secured within the window glass holder 1. It is thus seen that the mounting of the window glass h within the window glass holder 1 can be readily and easily accomplished without the need for initially holding the plate members j and k apart from each other and subsequently inserting the window glass h into the window glass holder 1, while the plate members j and k were maintained apart from each other, as was the case with the PRIOR ART window glass holder 1 shown in FIGS. 10(A) and 10(B).

Figure 7:
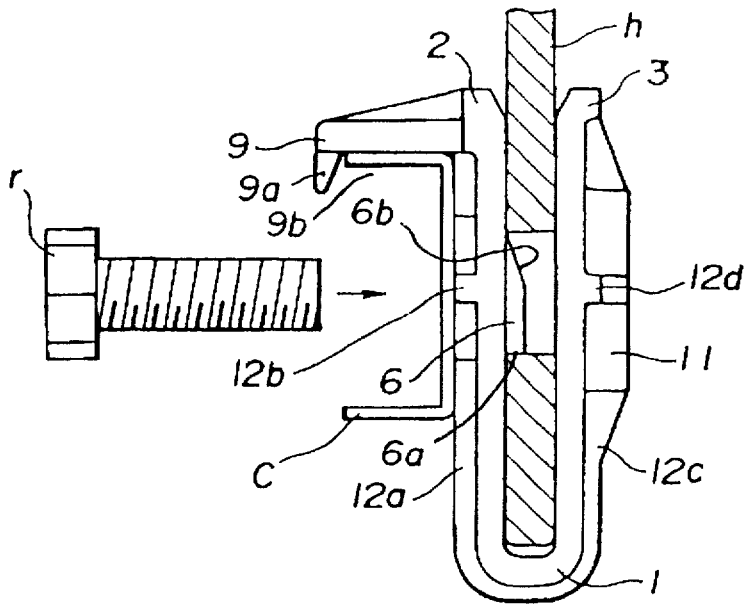
FIG. 7 is a side elevational view, similar to that of FIG. 5, wherein, however, the window glass is illustrated, in cross-section, as being secured within the window glass holder, the window glass-window glass holder subassembly is shown mounted upon a vertically movable rail member of a vehicle door window elevating-and-lowering system, and the window glass-window glass holder subassembly and the rail member are being secured together by a threaded bolt fastener.
Figure 8:
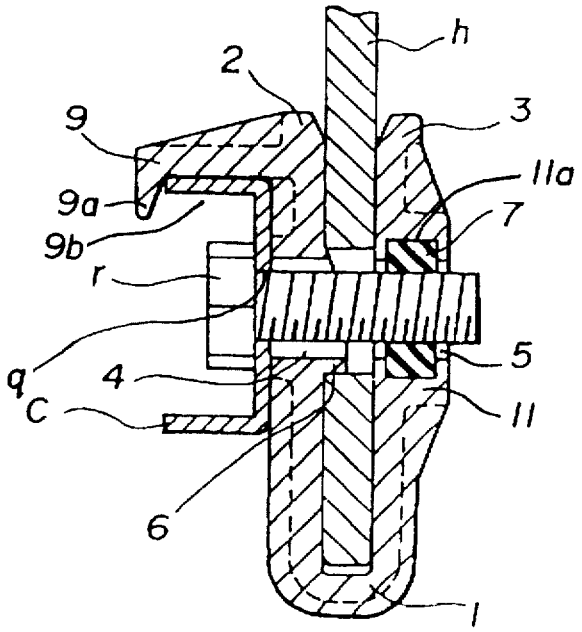
FIG. 8 is a cross-sectional view corresponding to the side elevational-partial cross-sectional view of FIG. 7, wherein the window glass-window glass holder subassembly and the vertically movable rail member have been secured together by means of the threaded bolt fastener.

Continuing further, and with reference now being made to FIGS. 7 and 8, when the aforenoted window glass h-window glass holder 1 subassembly is to be mounted upon and fixedly secured to the vertically movable rail member c of an elevating-and-lowering assembly housed within an automotive vehicle door panel so as to be raised and lowered to respective closed and opened positions, the seat member 9 of the plate member 2 is seated upon the upper flanged portion of the vertically movable rail member c in an overlying manner, or considered alternatively, the upper flanged portion of the rail member c is seated within the recessed region 9*b* such that the hook portion 9*a* of the seat member 9 engages the front edge portion of the upper flanged portion of the rail member c. The rail member c is thus properly seated with respect to the window glass holder 1 and the window glass h whereby the aperture q of the rail member c is automatically coaxially aligned with the through-bores 4 and 5 of the plate members 2 and 3. In this manner, a threaded bolt fastener r can be inserted through the coaxially aligned apertures q, 4 and 5 of the rail member c, plate member 2, and plate member 3 so as to threadedly engage the metal nut member 7 embedded within the plate member 3 whereby the window glass holder 1-window glass h subassembly is fixedly secured to the vertically movable rail member c of the automotive window elevating-and-lowering assembly.

It is thus apparent that with the window glass holder of the present invention, it is no longer necessary to separately support the window glass h and the window glass holder 1 with respect to the vertically movable rail member c when the threaded bolt fastener r is being inserted through the windowglass holder 1, the window glass h, and the vertically movable rail member c because with the window glass holder 1 of the present invention, the window glass holder 1 is seated and supported upon the vertically movable rail member c so as to automatically coaxially align the apertures of the window glass holder 1, the window glass h, and the rail member c and thereby facilitate and simplify the insertion of the threaded bolt fastener r through the window glass holder 1, the window glass h, and the rail member c for threaded engagement with the nut member 7 of the window holder 1. In addition, there is no need to provide existing rail members c with the window glass holding piece p whereby existing rail members c do not have to be structurally modified so as to have such window glass holding pieces p integrally mounted thereon.

Figure 9:
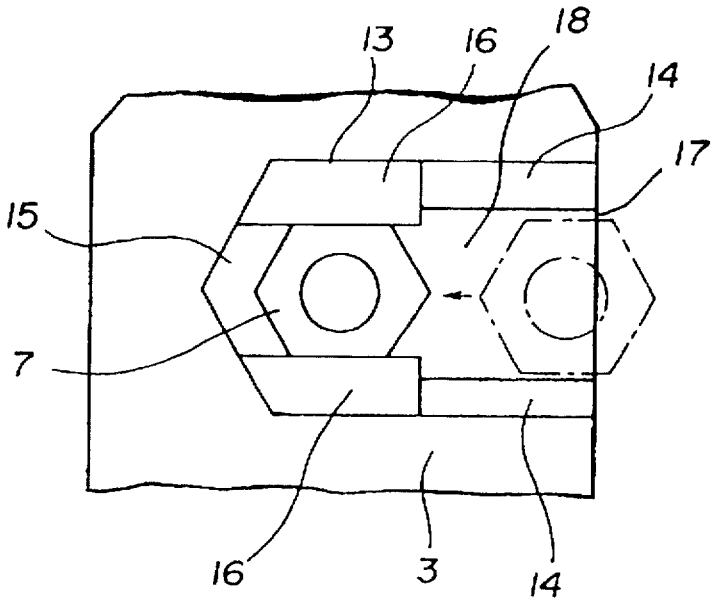
FIG. 9 is a partial rear elevational view of a second embodiment of a window glass holder constructed in accordance with the teachings of the present invention and showing the cooperative parts thereof.

Referring now to FIG. 9, a second embodiment of the window glass holder of the present invention is illustrated. While the first embodiment of the window glass holder as illustrated in FIGS. 1–4 was structurally fabricated such that the metal nut member 7 was embedded by insert molding techniques within an internal portion of the plate member 3, it is possible that the nut member 7 can be removably housed within a housing that is integrally formed upon an external surface portion of the plate member 3. As seen in FIG. 9, such an external housing 13 comprises a pair of vertically spaced, parallel guide strips or ribs 14,14 integrally formed upon the outer or external surface of the plate member 3 and which define, at the right end portions thereof, an opening 17 therebetween into which the metal nut member 7 can be inserted as seen by the phantom lines. Stop members 16,16 are provided along the left end portions of the guide strips or ribs 14,14 such that when the nut member 7 is inserted into the opening 17 and slid along a track 18 defined between the guide strips 14,14 from the right end portions thereof to the left end portions thereof, the nut member 7 will be retained upon the external or outer surface portion of the plate member 3 as a result of the stop members 16,16 overlying upper and lower peripheral portions of the nut member 7 as shown by the solid lines. A V-shaped strip or rib member 15 is in effect integrally connected to the left end portions of the stop member 16,16 so as to close off the left end portion of the track 18 so that the nut member 7 is not inadvertently disengaged from the track 18 and the plate member 3. In addition, the strip or rib member 15 serves to precisely define the lateral disposition of the nut member 7 upon the plate member 3 such that the nut member 7 can be coaxially aligned with the through-bores or apertures 4 and 5 respectively defined within the plate members 2 and 3. In this manner, the nut member 7 can be properly threadedly engaged with the threaded bolt fastener r when the latter is inserted through the vertically movable rail member c, the window glass holder 1, and the window glass h when the rail member c, the window glass holder 1, and the window glass h are to be fixedly assembled together for operative use within the automotive window elevating-and-lowering assembly incorporated within the automotive vehicle door. As has been noted hereinbefore, the nut member 7 is confined between the stop members 16 and the rear surface of the plate member 3 so as to be retained upon plate member 3 and not be inadvertently disengaged from plate member 3. In addition, it is to be further appreciated that as a result of being confined between the guide strips or ribs 14,14 and the V-shaped rib member 15, four sides of the hexagonal nut member 7 are engaged with the rib members 14 and 15 such that rotation of the nut member 7 with respect to the plate member 3 and the threaded bolt fastener r is positively prevented such that the threaded bolt fastener r can be properly threadedly engaged with the nut member 7.

Obviously, many modifications and variations of the present invention are possible in light of the above teachings. For Example, while the nut member 7 has been illustrated or shown to be a separate metal nut member, such a separate nut member may be dispensed with and the internal peripheral portions of one of the through-bores 4 and 5 of the plate members 2 and 3 may be internally threaded so as to serve as the nut member. In addition, while protrusion 6 and seat member 9 have been illustrated as being formed upon the same plate member 2 of the window glass holder 1, they may be formed upon separate plate members. It is therefore to be understood that within the scope of the appended claims, the present invention may be practiced otherwise than as specifically described herein.

What is new and desired to be secured by Letters Patent of the United States of America, is:

1. A window glass holder for fixedly retaining a window glass element, having a through-bore defined therein, within said window glass holder, comprising:

said window glass holder having a substantially U-shaped cross-sectional configuration and comprising a pair of axially spaced plate members disposed parallel to each other; and protrusion means fixedly disposed upon a first one of said pair of plate members and extending toward a second one of said pair of plate members for engagement within a through-bore defined within said window glass element to be fixedly retained within said window glass holder, said protrusion means comprising a shoulder portion for engaging the through-bore of the window glass element so as to fixedly retain the window glass element within said window glass holder, and a ramp portion for engaging an edge portion of the window glass element when the window glass element is inserted into said window glass holder such that said first and second plate members are expanded away from each other so as to enable the window glass element to be insertable into said space defined between said first and second plate members, whereby when said window glass element is inserted into said window glass holder such that an edge portion of the through-bore of the window glass element clears said protrusion means of said first one of said pair of plate members, said protrusion means will snap-engage into the through-bore of the window glass element so as to fixedly retain the window glass element within said window glass holder.

2. A window glass holder as set forth in claim 1, wherein:

said window glass holder is fabricated from a synthetic resin material.

3. A window glass holder as set forth in claim 1, further comprising:

a seat member fixedly mounted upon one of said pair of plate members for engaging a rail member of a window moving assembly whereby said window glass holder is properly mounted upon the rail member of the window moving assembly.

4. A window glass holder as set forth in claim 3, wherein:

said seat member comprises a dependent hook portion for engaging the rail member of the window moving assembly such that the window glass holder is mounted upon the rail member of the window moving assembly in an overlying manner.

5. A window glass holder as set forth in claim 3, further comprising:

through-bores defined within said pair of plate members for coaxial alignment with the through-bore of the window glass element; and nut means fixedly disposed upon one of said pair of plate members and coaxially aligned with said through-bores of said pair of plate members and the through-bore of the window glass element for threaded engagement with a threaded bolt fastener inserted through a through-bore of the rail member, said through-bores of said pair of plate members, and the through-bore of the window glass element so as to fixedly mount said window glass holder, and the window glass element disposed therein, upon said rail member.

6. A window glass holder as set forth in claim 5, wherein:

said nut means comprises a nut member embedded within said one of said pair of plate members.

7. A window glass holder as set forth in claim 5, further comprising:

means defining a housing upon an external surface portion of said one of said pair of plate members for removably housing said nut means therein.

8. A window glass holder as set forth in claim 7, wherein said housing comprises:

oppositely disposed stop members for defining a track therebetween and along which said nut means can be laterally movable so as to position said nut means with respect to said through-bores of said pair of plate members; and stop means disposed at one end of said track for limiting lateral movement of said nut means along said track so as to position said nut means at a predetermined position with respect to said through-bores of said pair of plate members, an opposite end of said track being open so as to permit insertion of said nut means into said track.

9. In combination, a window glass mounting system fixedly mounting a window glass element upon a vertically movable rail member of a window elevating-and-lowering assembly, comprising:

said window glass element having a through-bore defined therein;

a window glass holder having a substantially U-shaped cross-sectional configuration for receiving an edge portion of said window glass element within a space defined by a pair of axially spaced plate members disposed parallel to each other, wherein each one of said pair of plate members has a through-bore defined therein;

said rail member of said window elevating-and-lowering assembly having a through-bore defined therein;

protrusion means, fixedly disposed upon one of said pair of plate members and extending toward the other one of said pair of plate members so as to engage said edge portion of said window glass element when said edge portion of said window glass element is inserted into said space defined between said pair of plate members, for automatically separating said pair of plate members in response to said insertion of said edge portion of said window glass element into said space defined between said pair of plate members, and having a shoulder portion disposed within said through-bore of said window glass element when said window glass element is fully inserted into said window glass holder such that said window glass element is retained within said window glass holder;

support means provided upon one of said pair of plate members for supportably seating said window glass holder upon said rail member of said window elevating-and-lowering assembly; and fastening means extending through said through-bores of said rail member, said window glass holder, and said window glass element for fixedly retaining said window glass element within said window glass holder and upon said rail member of said window elevating-and-lowering assembly.

10. The combination as set forth in claim 9, further comprising:

said fastening means comprises a threaded bolt fastener; and nut means is disposed upon one of said pair of plate members for threaded engagement with said threaded bolt fastener.

11. The combination as set forth in claim 10, wherein:

said nut means is embedded within said one of said pair of plate members.

12. The combination as set forth in claim 10, wherein:

a nut housing is provided upon an external surface portion of said one of said pair of plate members for removably housing said nut means therein.

13. The combination as set forth in claim 9, wherein:

said window glass holder is fabricated from a synthetic resin material.

14. The combination as set forth in claim 9, wherein:

said rail member comprises a flanged portion; and said support means comprises a dependent hook portion for defining, along with said one of said pair of plate members, a recessed portion within which said flanged portion of said rail member is seated whereby said window glass holder is supportably seated upon said flanged portion of said rail member.

15. The combination as set forth in claim 9, wherein:

said protrusion means comprises an inclined ramp portion for engaging said edge portion of said window glass element, and said shoulder portion engages an edge portion of said through-bore of said window glass element.

16. In combination, a window glass assembly, comprising:

a window glass element having a through-bore defined therein;

a window glass holder having a substantially U-shaped cross-sectional configuration defined by a pair of axially spaced plate members disposed parallel to each other and defining a space therebetween for receiving an edge portion of said window glass element, wherein each one of said pair of plate members has a through-bore defined therein; and protrusion means, fixedly disposed upon a first one of said pair of plate members and extending toward a second one of said pair of plate members so as to engage said edge portion of said window glass element when said edge portion of said window glass element is inserted into said spaced defined between said pair of plate members, for automatically causing separation of said first one of said pair of plate members with respect to said second one of said pair of plate members in response to insertion of said edge portion of said window glass element into said space defined between said pair of plate members so as to permit insertion of said edge portion of said window glass element into said space defined between said pair of plate members, and having a shoulder portion disposed within said through-bore of said window glass element when said window glass element is fully inserted into said window glass holder such that said window glass element is retained within said window glass holder.

17. The combination as set forth in claim 16, further comprising:

nut means fixedly disposed upon one of said pair of plate members and coaxially aligned with said through-bores of said pair of plate members and said through-bore of said window glass element for threaded engagement with a threaded bolt fastener insertable through said through-bores of said pair of plate members and said through-bore of said window glass element so as to fixedly retain said window glass element within said window glass holder.

18. The combination as set forth in claim 17, wherein:

said nut means comprises a nut member embedded within said one of said pair of plate members.

19. The combination as set forth in claim 17, further comprising:

means defining a housing upon an external surface portion of said one of said pair of plate members for removably housing said nut means therein.

20. The combination as set forth in claim 19, wherein said housing comprises:

oppositely disposed stop members for defining a track therebetween and along which said nut means can be laterally movable so as to position said nut means with respect to said through-bores of said pair of plate members; and stop means disposed at one end of said track for limiting lateral movement of said nut means along said track so as to position said nut means at a predetermined position with respect to said through-bores of said pair of plate members, an opposite end of said track being open so as to permit insertion of said nut means into said track.

* * * * *